United States Patent [19]

Völkle

[11] Patent Number: 4,848,837

[45] Date of Patent: Jul. 18, 1989

[54] CHAIR HAVING A PELVIS-HIP SUPPORT ADJUSTABLE RELATIVE TO A FRONT SEAT PORTION

[76] Inventor: Rolf Völkle, Siemens-Strasse 2, D-7298 Lossburg, Fed. Rep. of Germany

[21] Appl. No.: 108,594

[22] Filed: Oct. 15, 1987

[30] Foreign Application Priority Data

Oct. 15, 1986 [DE] Fed. Rep. of Germany ..... 3635044

[51] Int. Cl.[4] ..... A47C 1/02

[52] U.S. Cl. ..... 297/300; 297/301; 297/316

[58] Field of Search ..... 297/300, 316, 317, 322, 297/301, 304

[56] References Cited

U.S. PATENT DOCUMENTS

| | | | |
|---|---|---|---|
| 4,380,352 | 4/1983 | Diffrient | 297/301 X |
| 4,533,177 | 8/1985 | Latone | 297/301 |
| 4,685,730 | 8/1987 | Linguanotto | 297/316 |
| 4,693,514 | 9/1987 | Volkle | 297/355 X |
| 4,709,963 | 12/1987 | Uecker et al. | 297/316 |

FOREIGN PATENT DOCUMENTS

| | | | |
|---|---|---|---|
| 0185388 | 6/1986 | European Pat. Off. . | |
| 1256840 | 3/1965 | Fed. Rep. of Germany . | |
| 2001097 | 9/1971 | Fed. Rep. of Germany | 297/301 |
| 3322450 | 1/1985 | Fed. Rep. of Germany | 297/300 |
| 169607 | 10/1921 | United Kingdom | 297/317 |

*Primary Examiner*—Kenneth J. Dorner
*Assistant Examiner*—Laurie K. Cranmer
*Attorney, Agent, or Firm*—Spencer & Frank

[57] ABSTRACT

A chair has a spring rocker which is articulatad to a seat support at a front edge of the seat. The rocker is connected to a pelvis-hip support by a horizontal pivot device. An entrance section of the pelvis-hip support is longer than an exit section thereof. Synchronizing levers connect the seat support and the pelvis-hip support in such a way that pivoting of the seat results in a relatively greater pivoting of the pelvis-hip support. A backrest is pivotably connected to the exit section of the pelvis-hip support toward the rear against the force of a spring by movement of the body of a seated person. This permits the shell elements of the shell contour of the chair to conform better to the course of movement executed by the body, of the seated person, and to give support throughout the pelvis-hip region of the body of the seated person.

17 Claims, 10 Drawing Sheets

FIG. 6
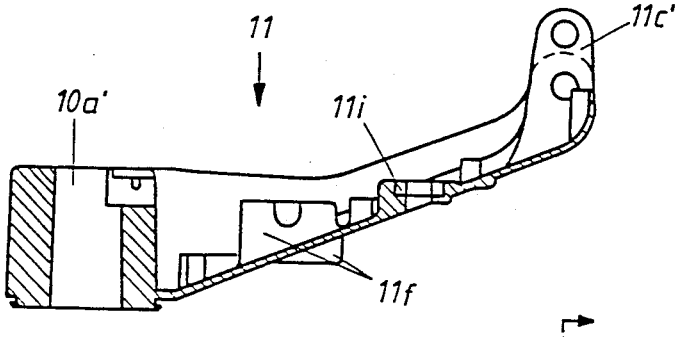
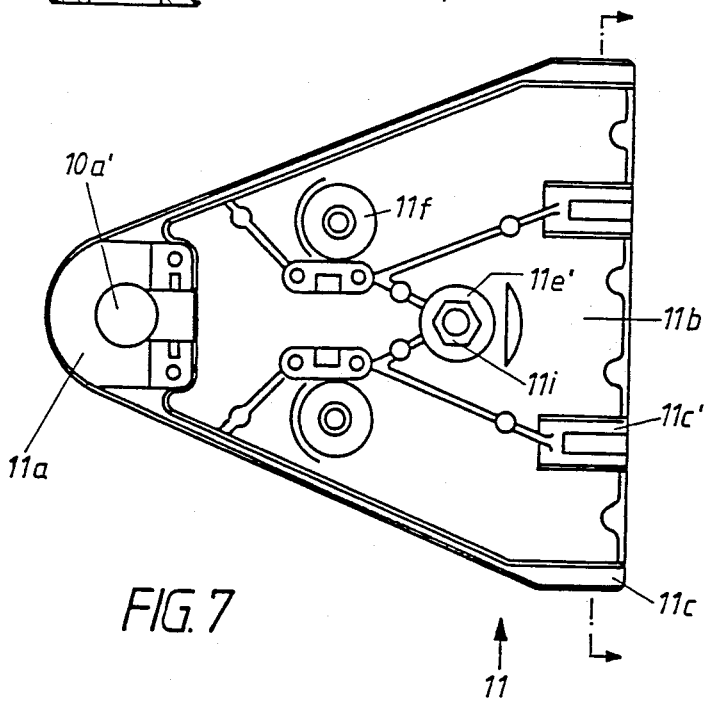
FIG. 7
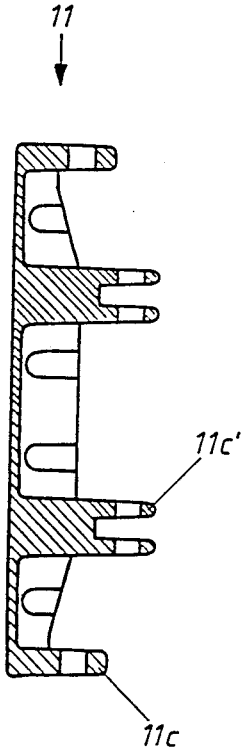
FIG. 8

FIG. 9
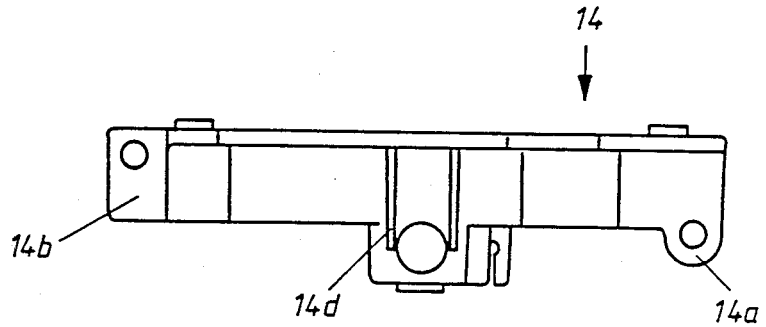
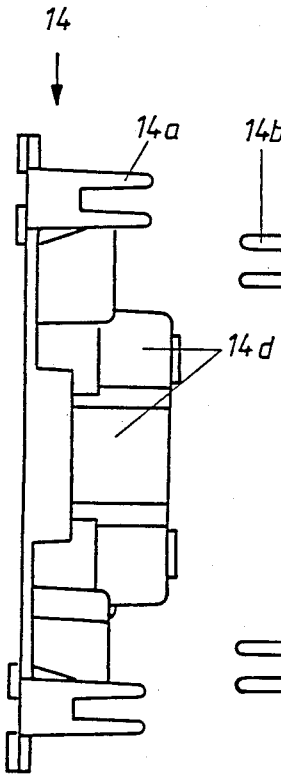
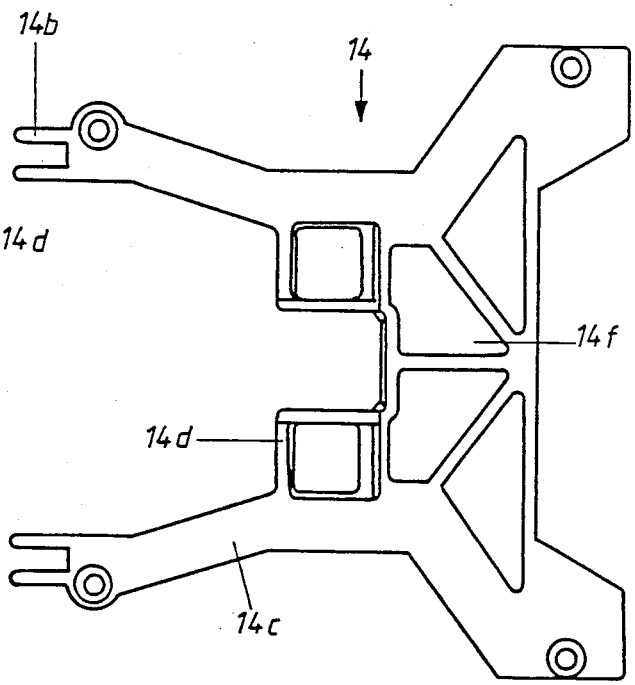
FIG. 11
FIG. 10

CHAIR HAVING A PELVIS-HIP SUPPORT ADJUSTABLE RELATIVE TO A FRONT SEAT PORTION

BACKGROUND OF THE INVENTION

The invention relates to a chair having a seat and a back whose inclination can be adjusted.

In a prior art chair of this type (European Pat. No. 0,185,388), corresponding to U.S. Pat. No. 4,685,730 change of a chair from the working position to a reclining position causes an adjustment device to effect a simultaneous, synchronous displacement of a front seat portion (reference numeral 2 thereof) as well as a backrest and a pelvis-hip support, the initial section of which extends at least over the entire hip region of the chair user's spine. If the prior art chair is in the working position, the seat surface extends approximately horizontally. The adjustment device includes an adjustment lever which is curved about approximately 90° and is articulated to the seat support and engages in an articulated manner at the backrest. The adjustment lever is pivotable by means of a pneumatic cylinder. The pelvis-hip support is supported on the adjustment lever by way of an approximately vertically disposed spring "ressort mécanique" (page 3, paragraph 5).

It is also known to divide the chair contour supporting the chair user into a section forming the seat surface, a pelvis supporting section and a section forming the backrest and to make the pelvis support adjustable. The latter may also be done in such a manner that the user has no influence on the adjustment (German Pat. No. 1,256,840, column 3, lines 39–47).

In a prior art chair of a comparable type, the rocker can be fixed in a set position by means of a friction locking multiple disc clutch through which passes a clamping rod, and a positive and synchronous adjustment of the inclination of the seat section and the backrest is provided approximately in a ratio of 1:2 (Embodiment of FIGS. 6, 6*a*), for example see U.S. Pat. No. 4,693,514 and Canadian Application No. 486,589.

SUMMARY OF THE INVENTION

It is an object of the invention to provide an improved a chair of the above-mentioned type such that its shell elements, which divide the chair shell contour into stable supporting zones and flexible elastic zones, adapt themselves automatically infinitely, and much better to the motion sequences of a human body occurring as a result of such change, i.e. to the active movements of the body, when the chair user changes his sitting position, while continuously supporting the pelvis-hip area of the chair user's body.

This is accomplished by the present invention having a seat and adjustable back which are articulated by a mechanism having first, second, and third pivot axes. In this device, approximately one third of the seat surface is formed by the pelvis-hip support. The third hinge axis is so low that it is still disposed within the chair user's hip region (≈the statistical mean of body sizes). The enforced pivot ratio between a pelvis-hip support and a front seat portion (S) brings about the result that, in the working position of the chair, the seat surface is bent, so to speak, in that the supporting area of the entrance section of the pelvis-hip section forms an obtuse angle ($\beta$ in FIG. 2) with the adjacent supporting face of the front seat portion. It is possible to use body movement to pivot the backrest portion, which is articulated by way of the third pivot axis, backward against the force of a spring, thereby meeting a frequent desire, particularly of young persons, to stretch their backs toward the rear. Such backward pivoting is possible in the working position of the chair, in the reclining position of the chair, and in intermediate positions of the chair.

The rocker which accommodates the seat shell of the chair is provided with a suspension to support the user's weight and ensures, in conjunction with harmoniously graduated upholstering of the various supporting areas of its seat shells, pleasant seat and back contact, thanks to the large-area accommodation of the weight of the body. The synchronous adjustment of the seat surface, the rear transition zone and the backrest profile produces low-fatigue balancing of the torso, while providing optimum mobility, and prevents excess tilting of the pelvis area in any position of the seat.

BRIEF DESCRIPTION OF THE DRAWINGS

The invention will be described below with reference to embodiments which are illustrated in the drawing figures.

FIG. 6 is a side sectional view of a seat support as viewed in the opposite direction from that of FIG. 2.

FIG. 7 is a top elevational view of the seat support of FIG. 6.

FIG. 8 is a sectional view of the seat support seen on line VIII—VIII of FIG. 7.

FIG. 9 is a side elevational view of the rocker as viewed in the opposite direction from that of FIG. 2, which together with the seat shell and its associated upholstery forms the seat section.

FIG. 10 is a top elevational view of the rocker of FIG. 9.

FIG. 11 is a side elevational view of the rocker of FIG. 10.

DESCRIPTION OF THE PREFERRED EMBODIMENTS

Figure 1:
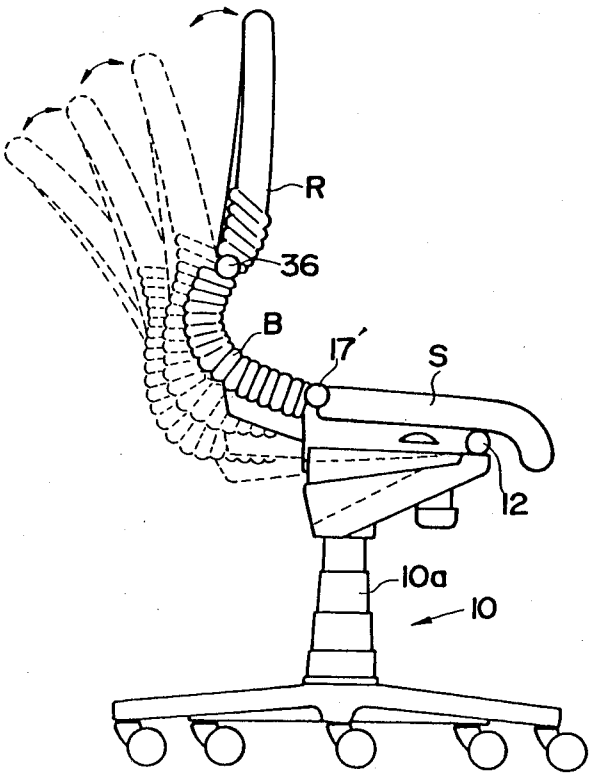
FIG. 1 is a schematic side elevational view of the chair of the present invention in the working position, with other positions of use down to its extreme reclining position being indicated in dashed outlines.

The schematic illustration of FIG. 1 shows a convertible chair structure and the conversion of the chair (for example, by movement of the user's body) from an optimum position shown in solid outline for the posture of the working user to an extremely rearward reclining position (shown in dashed lines).

Figure 2:
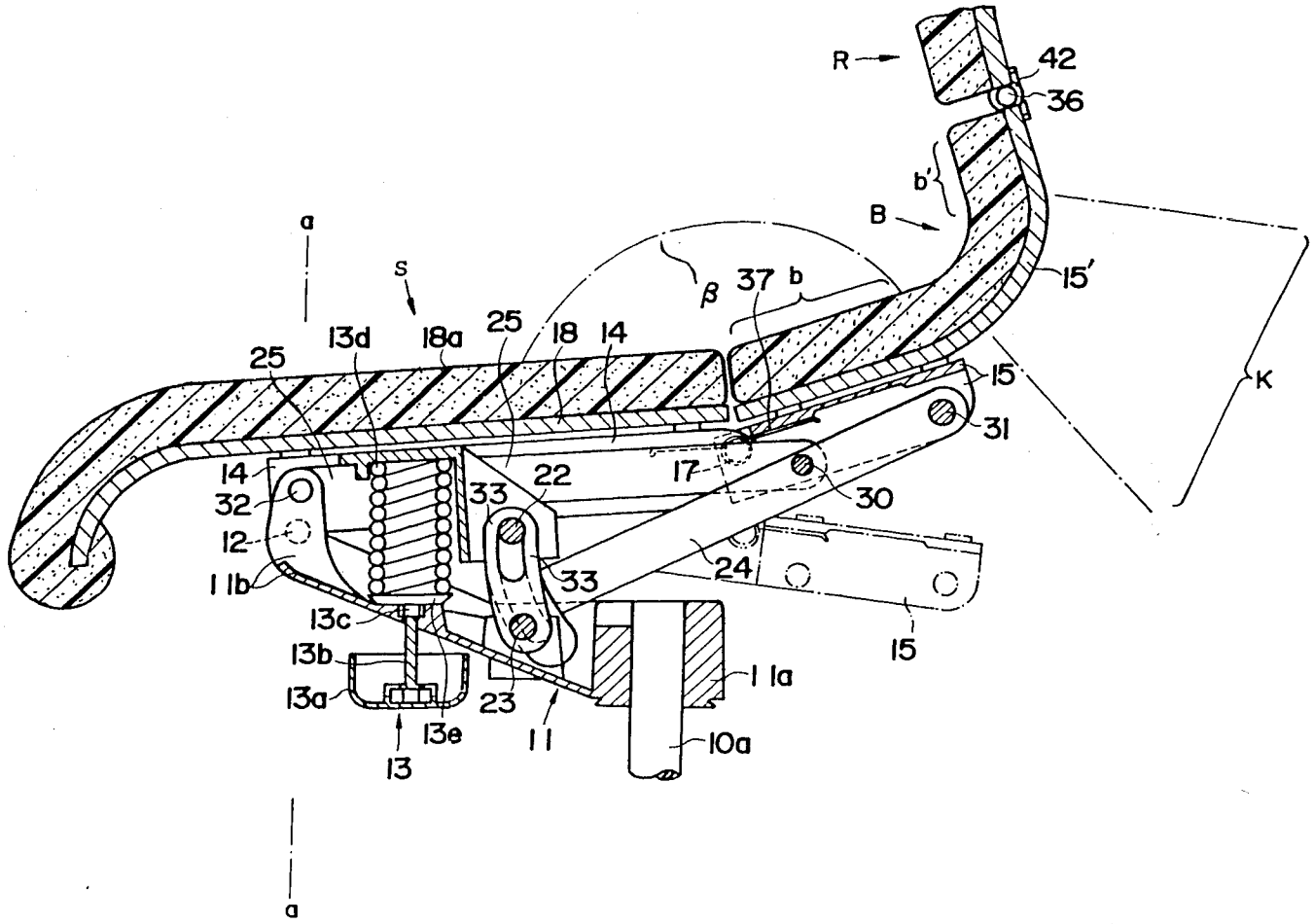
FIG. 2 is an enlarged side sectional view of the chair as seen from the rear of FIG. 1, as taken along the vertical plane of symmetry, with its rest position being indicated in dashed outline, for a seat rocker and a pelvis-hip support.
Figure 4:
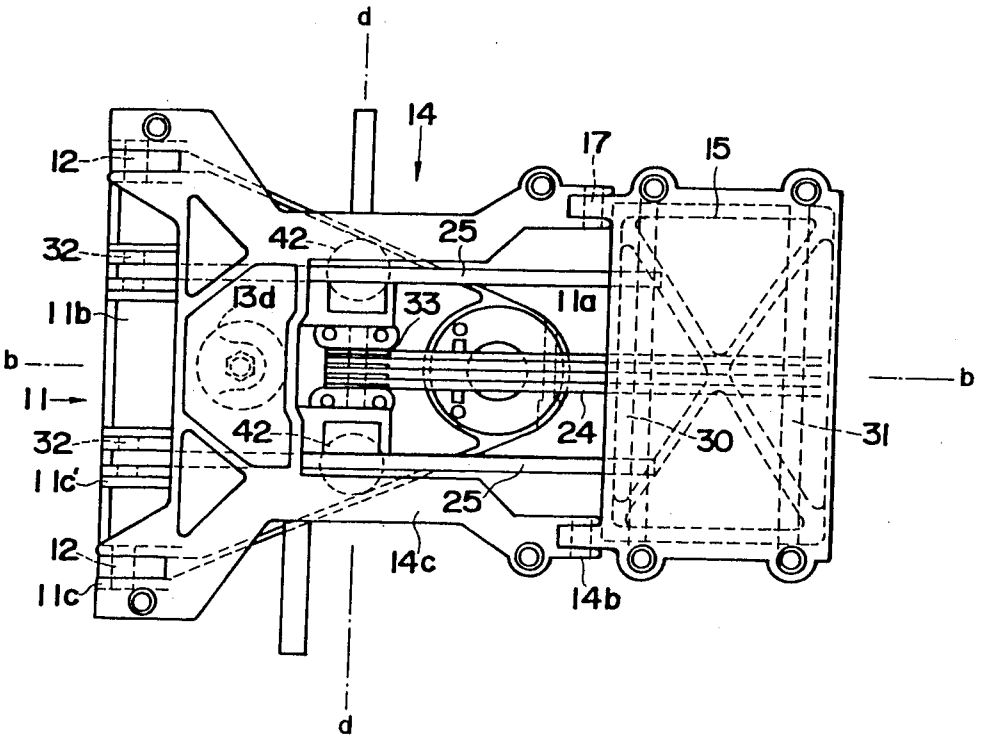
FIG. 4 is a top elevational view of the chair of FIG. 3, with the shell elements of the seat and the pelvis-hip support shell removed.
Figure 5:
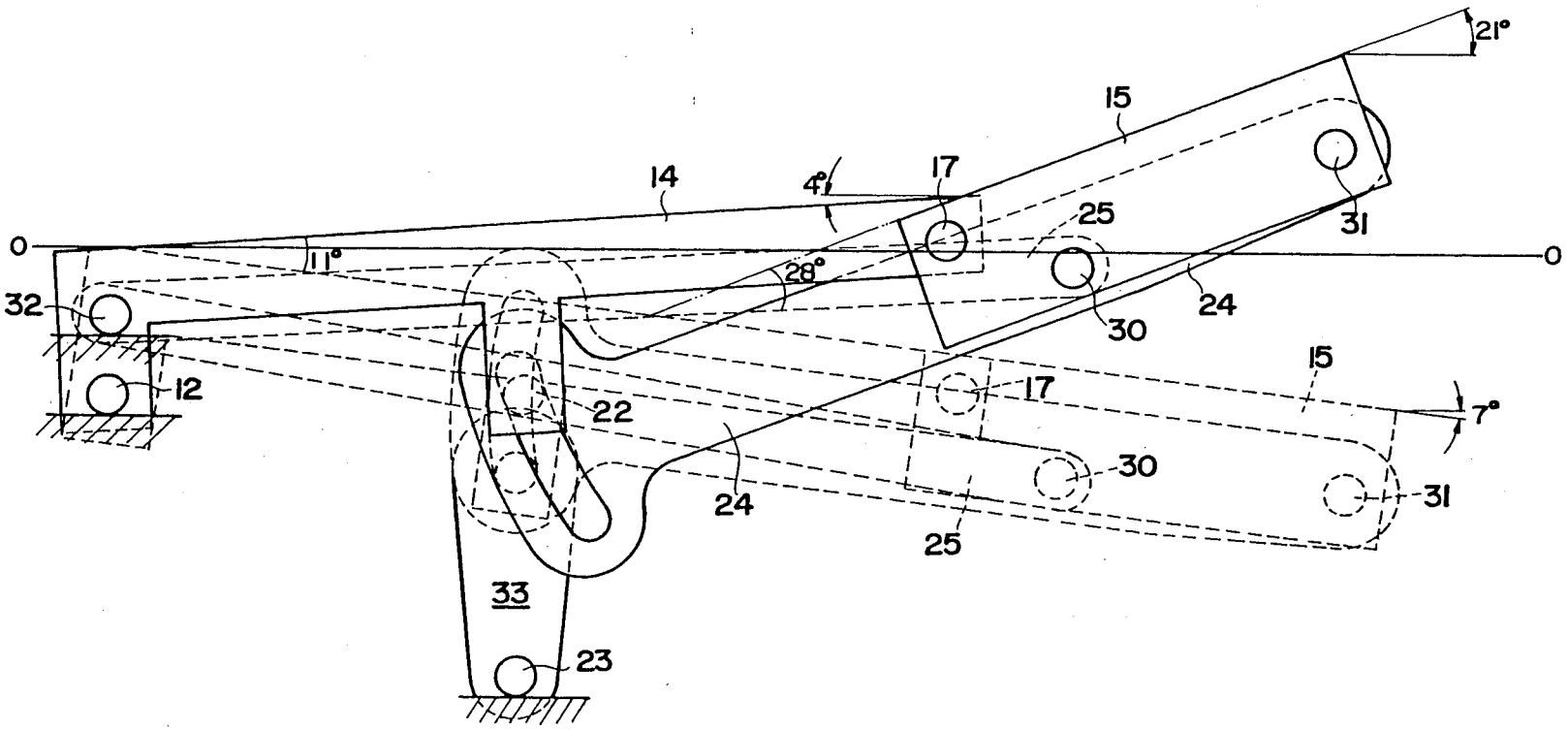
FIG. 5 is a schematic side elevational representation of the mechanism connecting the rocker and the pelvis-hip support, and including a control lever, used for the synchronous adjustment of the pelvis-hip support, when the chair is in the working position (solid outline) in the reclining position (dashed outline).
Figure 12:
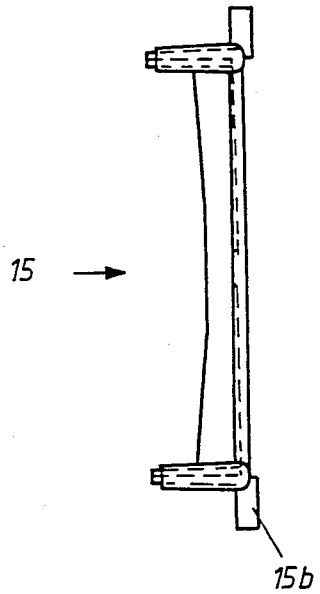
FIG. 12 is a side elevational view of the supporting plate of FIG.4 which together with its supporting shell and associated upholstery forms the pelvis-hip support.
Figure 13:
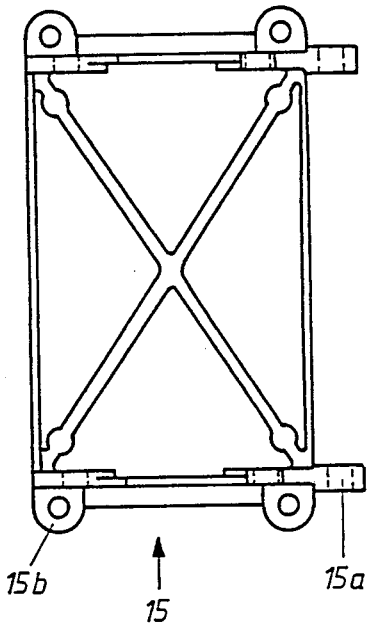
FIG. 13 is a lower elevational view of the supporting plate as seen from the left of FIG. 12.
Figure 14:
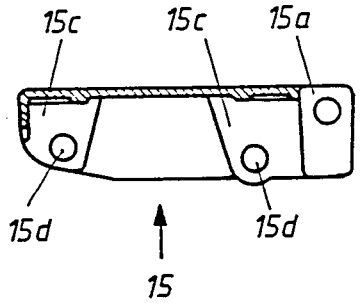
FIG. 14 is a sectional side view taken along line XIV—XIV of FIG. 13.

A foot rest 10 includes a variable height supporting spindle 10*a*. As shown in FIG. 2, it rotatably accommodates a seat support 11 which is shown in detail in FIGS. 6 to 8. In the region of a receptacle 11*a* which is provided with a receiving bore, the seat support 11 is pushed onto the upper end of the supporting spindle 10. The seat support 11 extends forward (toward the front of the chair) and becomes wider to end in a bearing section 11*b* (as seen in FIG. 4) which is and elongated is oriented transversely to the plane of symmetry indicated by line b—b in FIG. 4. Bearing eyes 11*c*′ for receiving coaxial swivel pins 32 of a pair of synchronizing levers 25 are disposed on the bearing section 11*b*, and bearing eyes 11*c*′ are also provided for receiving swivel pins 12 having an axis 12′, referred to hereafter as the first pivot axis 12′, as can be seen in particular in FIGS. 6 to 8 in conjunction with FIG. 4. As can be seen particularly in FIG. 7, the vertical parallel projection of the seat support 11 corresponds approximately to an isosceles triangle. A seat S as seen in FIG. 2, includes a rocker 14, an associated seat shell 18 and upholstery 18*a*, and is articulated by the swivel pins 12, about the first pivot axis 12′, to the seat support 11 by way of the rocker 14 in a region adjacent the front edge of seat S. By way of swivel pins 17 disposed along a second horizontal pivot axis 17′ (shown in FIGS. 1 and 2), the rear of the rocker 14 is connected with a pelvis-hip support B which ends in the region of the seat user's hip. The pelvis-hip support B has upholstery 15*a* which is attached to and supported by a pelvis-hip support shell 15′. The pivoting of the seat S and the pelvis-hip support B caused by the movement of the body is synchronized by the pair of synchronizing levers 25 in such a manner that pivoting of the seat S enforces pivoting of the pelvis-hip support B about a pivot angle which is 2.5 times greater than the pivot angle of the seat S. A backrest R is connected directly to the upper edge of the pelvis-hip support B swivel pins 36 having a third pivot axis 36′. Backward pivoting of the backrest R due to movement of the body takes place against the force of a spring. This spring is preferably formed by leg springs 42 (FIG. 2) which are received by the swivel pins 36 which have the third pivot axis 36′ and whose legs lie, on the one hand, against the pelvis-hip support B and, on the other hand, against the backrest R.

Figure 3:
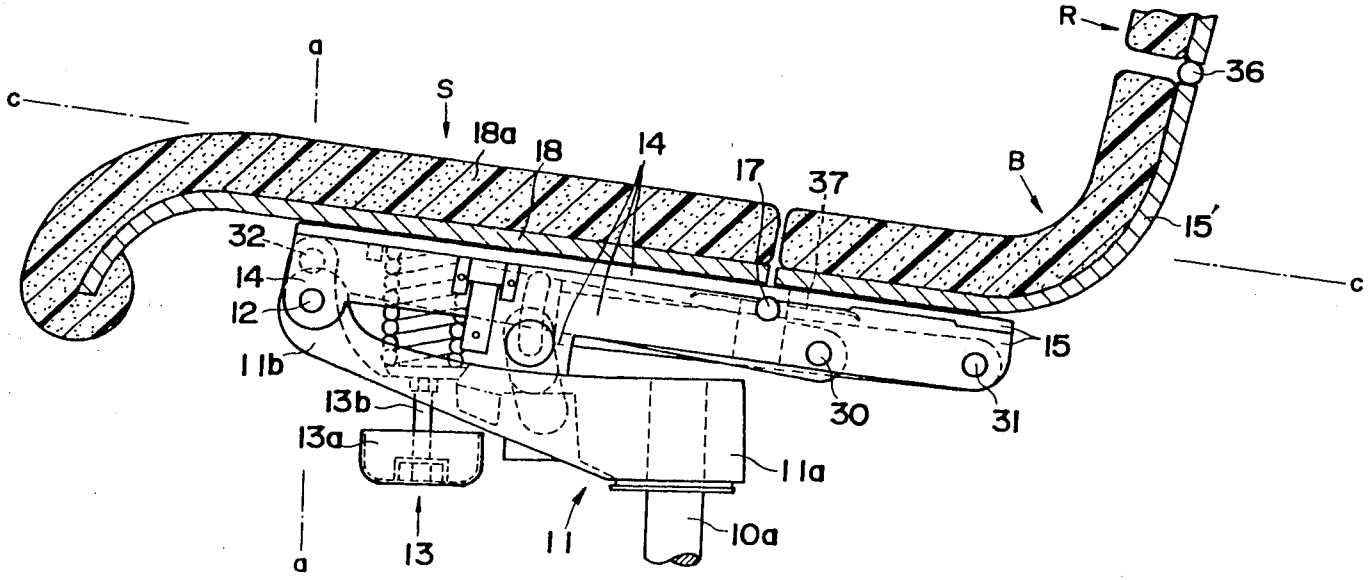
FIG. 3 is a side elevational view of the chair as seen in FIG. 2 with its upholstery and seat shell shown in section, with the chair in the reclining position.

As can be seen particularly well in FIGS. 2 and 3, the entrance section b of the pelvis-hip support B following the seat S extends approximately perpendicularly to an exit section b′ following the backrest R. This exit section b′ is approximately half as long, as the entrance section b. Entrance section and the exit section b′ are connected to one another by an arcuate curved section k (FIG. 2). The synchronizing levers 25 engage at the seat support 11 by way of the coaxial swivel pins 32 for pivotable movement about a synchronizing lever pivot axis 32′. The swivel pins 32 are disposed approximately in a vertical plane a—a passing through the pivot axis 32′ (FIG. 2) of the rocker 14 (FIGS. 2 and 3). At their other ends, the synchronizing levers 25 are articulated by way of a support plate 15 disposed at the pelvis-hip support B by swivel pins 30 having a transverse lever pivot axis 30′. The transverse axis 30′ is arranged offset toward the rear and the bottom with respect to the second pivot axis 17′ of formed by the rocker 14 and the support plate 15 the swivel pins 17 so that a pivot ratio of about 1:5 results between the rocker 14 and the pelvis-hip support B. To arrest the set inclinations of the seat S and the pelvis-hip support B, two friction locking multiple disc clutches 24, 33 are provided which are symmetrical with respect to a plane of symmetry passing through line b—b (FIG. 4) and are penetrated by a clamping rod 22 which is manually controllable by means of an eccentric member, such as a rotatable cylindrical member having a side cam face for urging the clutches 24 and 33 together into frictional engagement. The friction locking multiple disc clutch 24 arresting the pelvis-hip support B is rigidly connected with the pelvis-hip support B by the swivel pins 30 having the a transverse axis 30′ and by a transverse pin 31 parallel to transverse axis 30′ and extending forward to below the seat S. At its frontal, broader end, the friction locking multiple disc clutch 24 is provided with an arcuate longitudinal slot 22*a* through which passes the clamping rod 22. A friction locking multiple disc clutch 33 having a slot 33*a* for arresting the rocker 14 is pivotally mounted on swivel pins 23 having a stationary bearing axis 23′ of the seat support 11 and extends in an approximately vertical direction. The slot 33*a* slideably receives the clamping rod 22 which is fixed to the rocker 14. The length of the arcuate longitudinal slot 33*a* determines the potential pivot angle of the rocker 14 and thus of the seat S. In the region of the clamping rod 22, the friction locking discs of the friction locking multiple disc clutch 24 for the pelvis-hip support B and the friction locking multiple discs of the friction locking multiple disc clutch 33 for the rocker 14 lie alternatingly against one another, thus resulting in a space saving arrangement of the arresting means. A coil spring 13*d* providing for the suspension of the rocker 14 is arranged symmetrically to the plane of symmetry b—b (FIG. 4) between the supporting spindle 10*a* and the front edge of the seat S and is caught in a supporting bearing 41 of the rocker 14 and in a lower bearing plate 13*e*. The coil spring 13*d* is provided with a device 13 to change its initial tension. The device 13 includes a screw bolt 13*b* equipped with a hand wheel 13*a*, the bolt 13*b* being in engagement with the internal thread of a screw nut 13*c* fixed to the seat support 11, as can be seen particularly in FIG. 2. The bearing plate 13*e* is seated on the screw bolt 13*b* and is thus able to transfer the axial motion component of the revolving screw bolt 13*b* to the coil spring 13*d*. Two further coil springs 42 (shown in FIG. 4) disposed at both sides of the plane of symmetry b—b are provided as suspension means for the rocker 14. Their arrangement in the area between a bore 10*a*′ and the coil spring 13*d* is evident in FIG. 7 where abutments 11*f* for these further coil springs 42 are indicated. FIG. 7 also shows the position of the coil spring 13*d* in which a support face 11*e*′ can be seen thereon on which the bearing plate 13*e* rests when the coil spring 13*d* is slightly pretensioned. The reference numeral 11*i* identifies a recess corresponding to the screw nut 13*c* in which this screw nut 13*c* is form-lockingly accommodated.

The swivel pins 17 (FIGS. 2, 3) forming the second pivot axis 17' pass through bearing eyes **14*b* of the rocker 14 which in turn is supported by bearing eyes 14*a* (seen in FIGS. 4,10 and 11) on the swivel pins 12. As can be seen, in particular, in FIG. 10, the rocker 14 has two arms 14*c* which extend between the bearing eyes 14*a* and 14*b* and are connected together by a bridge 14*f*. Reference numeral 14*d* identifies shaped portions which form a bearing for the clamping device to arrest the inclination of the seat S and pelvis-hip support B. If the chair is in a working position, namely with the backrest R and the pelvis-hip support B in their uppermost positions, the third pivot axis 36 of the backrest R is approximately 14 cm above the pivot axis 17' of the pelvis-hip support B. If the chair is in the extreme reclining position, namely with the backrest R and the pelvis-hip support B in their lowermost positions, the supporting face of the entrance section b of the pelvis-hip support B and the supporting face of the seat S lie in a common plane c—c which is slightly downwardly inclined toward the rear of the chair (FIG. 3**).

In special cases, it may be advisable to support the synchronous pivoting of the pelvis-hip support B from its lower pivot position (FIG. 3) into its upper pivot position (FIG. 2) by the force of a spring, preferably by leg springs 37 (FIGS 2, 3).

Figure 15:
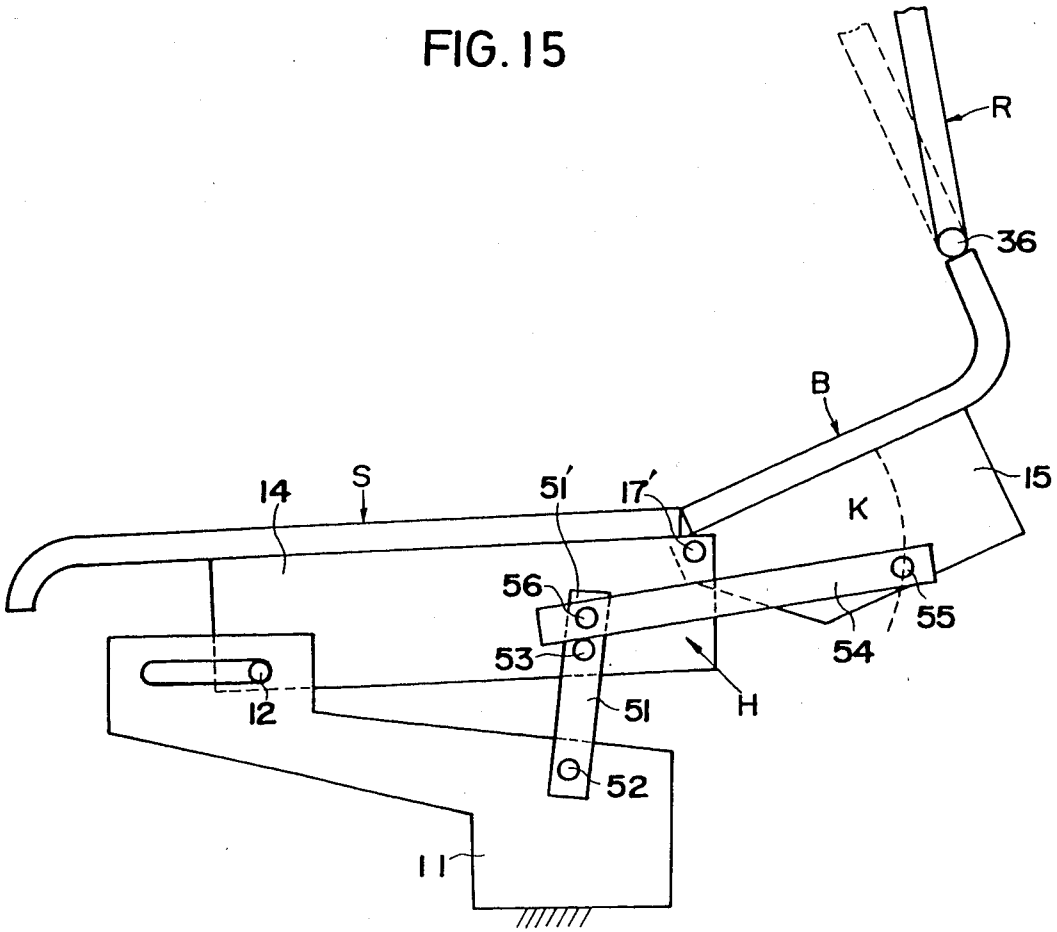
FIGS. 15 and 16 are schematic side elevational views, of two different operational positions, respectively showing a working position and a reclining position, of a device for horizontally shifting the body-supporting shell contour as a function of the swinging motion of the pelvis-hip support according to the invention.
Figure 16:
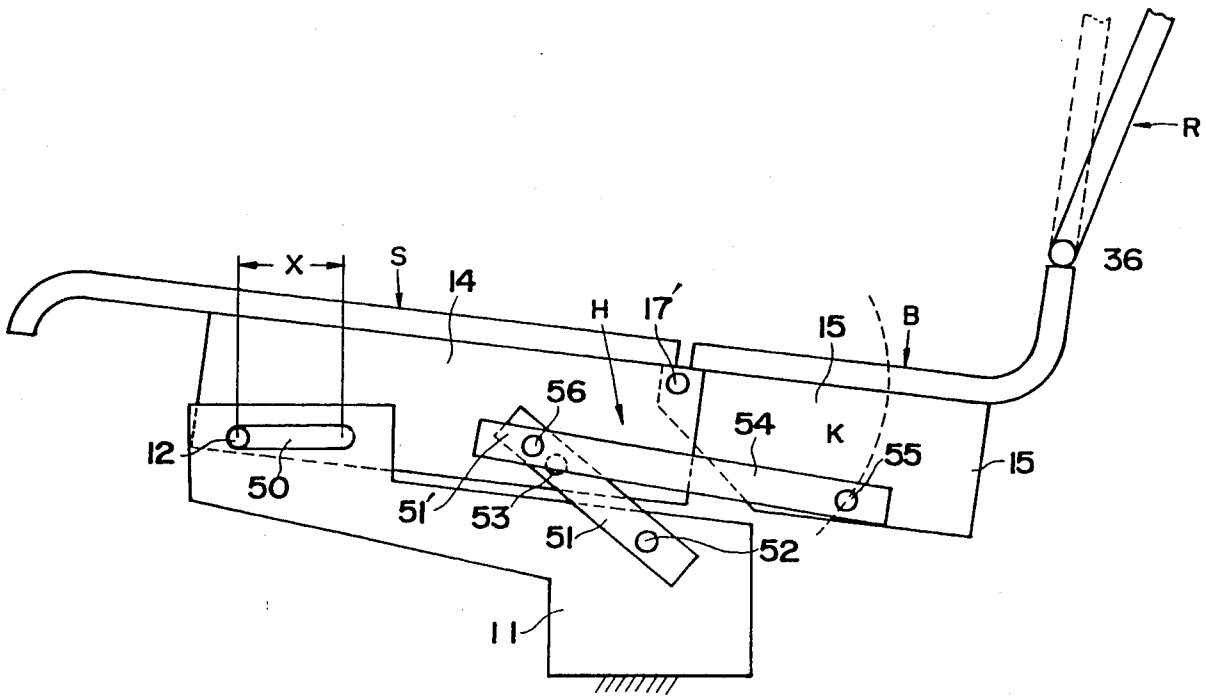

If, after releasing the blockage of the set inclinations of the seat portion S and the pelvis-hip support B, the person seated in the chair leans backward, the chair moves, by virtue of the body motion, from a working position (FIGS. 2 and 15) into a position of rest (FIGS. 3 and 16). In the position of rest the seated person can rearwardly bend his/her back against the force of the springs 42 (as seen in FIG. 4). This results in an appreciable rearward shift of the center of gravity of the seated person so that the chair is in danger of a rearward toppling. This danger may be counteracted, for example, by a corresponding limitation of the rearward swinging motion of the backrest R.

In many cases, however, it is a desideratum to provide for a possibly substantial swinging path of the backrest R to achieve a desired stretch of the seated person's back. For such a case, in order to ensure reliably the elimination of the danger of a backward toppling of the seat, according to the invention a device is provided which effects a forward shift of the center of gravity of the body of the seated person when leaning backwardly until the backrest executes its maximum excursion. The construction and mode of operation of this device will now be described in conjunction with FIGS. 15 and 16. As schematically shown in FIG. 15, which is a side elevational view of a mechanism which is symmetrical about a central plane parallel to the plane of the figure, shaft pins 12 of the rocker 14 are horizontally displaceably supported in horizontal slots 50 of the stationary seat carrier 11. As seen in FIG. 16 the maximum path of displacement X corresponds to the length of the slots 50. As may be observed from a comparison of FIGS. 15 and 16, the body-supporting shell contour formed of the frontal seat portion S, the pelvis-hip support B and the backrest R is displaceable rearwardly to an extent X as the chair is moved from the working position (FIG. 15) into the position of rest (FIG. 16). The shift is effected with the aid of a linkage H jointed with the rocker 14 for the seat portion S, the support plate 15 for the pelvis-hip support B, and the stationary seat carrier 11. The linkage H includes two levers 51 which are each, at one end thereof, jointed to the stationary seat carrier 11 by means of a shaft pin 52 and at the other end thereof are each articulated to the rocker 14 by means of a shaft pin 53. By means of shaft pins 56 two further levers 54 are jointed to upper extension terminals 51' of the levers 51. The levers 54 are, at their respective rear portions, articulated by means of shaft pins 55 to the support plate 15 for the pelvis-hip support B. The rearward swing of the backrest R which may be effected by body motion against the force of the spring 42 (shown in FIG. 2) about the third pivot axis 36' is indicated by the rear pivoted position of the backrest shown in solid lines in FIGS. 15 and 16, while the forward swing effected by the spring 42 is shown by broken lines in FIGS. 15 and 16.

The horizontal shift of the body-supporting shell contour formed of the frontal seat part S with the rocker 14, the pelvis-hip support B with the support plate 15 and the backrest R, causes a for motion of the body-supporting shell contour, as a unit, through a distance X. As may be observed from a comparison between FIGS. 15 and 16, during this occurrence the levers 54, by virtue of a positive force transmitted thereto by the shaft pins 55 which travel about the second pivot axis 17 are shifted through an arcuate path k from a position shown in FIG. 15 substantially in a forward direction into a position according to FIG. 16. By virtue of this occurrence, the levers 51 are pivoted about the stationary shaft pins 52 from their position shown in FIG. 15 into the position shown in FIG. 16. Since the levers 51 are, in their upper half, articulated by shaft pins 53 to the rocker 14, by virtue of their pivotal motion the unit designated as the body-supporting shell contour is displaced forwardly through the distance X. In this manner there is obtained, upon the transition of the chair from the working position according to FIG. 15 into the position of rest according to FIG. 16, a shift of the center of gravity of the body of the seated person by the distance X in a forward direction. In this manner, the danger of a rearward toppling of the chair is reliably prevented even if, in the position of rest, the seated person leans backward such that the backrest executes its maximum rearward pivoting motion.

By virtue of the segmentation of the body-supporting shell contour determined by the pelvis-hip support B and based on principles of the anatomy of the sitting position, the specific synchronous shift of the seat portion S and the pelvis-hip support B, as well as the return-resiliency of the backrest R joined to the pelvis-hip support B, leads to a "dynamic sitting" posture with an upright position of the seated person's spinal column in the zone of the pelvis and hip.

It will be understood that the above description of the present invention is susceptible to various modifications, changes and adaptations, and the same are intended to be comprehended within the meaning and range of equivalents of the appended claims.

What is claimed is:

1. A chair, comprising:

a rocker;

a front seat portion supported by said rocker;

a backrest having an adjustable inclination;

a foot rest having a supporting spindle which is adjustable in height;

a seat support connected to said supporting spindle, said seat support being pivotably connected by first pivot means to a front portion of said rocker, such that said rocker is pivotable relative to said seat support over an angle range which includes a horizontal angle;

a pelvis-hip support including a pelvis-hip support plate, said pelvis-hip support plate being pivotably connected by second pivot means to a rear portion of said rocker, said pelvis-hip support having an entrance section and an exit section which extends generally perpendicularly to said entrance section, said entrance section being longer than said exit section, said exit section being adapted to support a hip region of a seated person;

third pivot means pivotably connecting said exit section to said backrest;

adjustment means for changing the inclination of said front seat portion and said pelvis-hip support between a working position and a reclining position;

said entrance section and said front seat portion together forming a seat surface which, when said backrest is in said reclining position, is disposed approximately in a plane which is slightly downwardly inclined in a direction which extends from said front seat portion toward said pelvis-hip support; said adjustment means including a plurality of synchronizing levers; each of said synchronizing levers being pivotably connected at one end thereof to said pelvis-hip support plate by synchronizing lever pivot means, and each of said synchronizing levers being pivotably connected at the other end thereof to said seat support by transverse lever pivot means; and said synchronizing lever pivot means being disposed at a first distance from said first pivot means, and said transverse lever pivot means being disposed at a second distance from said second pivot means, said first and second distances being related such that when said front seat portion is pivoted, said pelvis-hip support is proportionately pivoted through a greater angle than said front seat portion; further comprising:

a plurality of slots disposed in said seat support; and a linkage means for horizontally moving said rocker, said front seat portion, said support plate having said pelvis-hip support, and said backrest as a structural unit as a function of the swinging motion of said pelvis-hip support along a distance having a length which corresponds to the length of said plurality of slots;

said rocker having shaft pins displaceably supported in respective ones of said plurality of slots.

2. A chair, comprising:

a rocker;

a front seat portion supported by said rocker;

a backrest having an adjustable inclination;

a foot rest having a supporting spindle which is adjustable in height;

a seat support connected to said supporting spindle, said seat support being pivotably connected by first pivot means to a front portion of said rocker, such that said rocker is pivotable relative to said seat support over an angle range which includes a horizontal angle;

a pelvis-hip support including a pelvis-hip support plate, said pelvis-hip support plate being pivotably connected by second pivot means to a rear portion of said rocker, said pelvis-hip support having an entrance section and an exit section which extends generally perpendicularly to said entrance section, said entrance section being longer than said exit section, said exit section being adapted to support a hip region of a seated person;

third pivot means pivotably connecting said exit section to said backrest;

adjustment means for changing the inclination of said front seat portion and said pelvis-hip support between a working position and a reclining position;

said entrance section and said front seat portion together forming a seat surface which, when said backrest is in said reclining position, is disposed approximately in a plane which is slightly downwardly inclined in a direction which extends from said front seat portion toward said pelvis-hip support; said adjustment means including a plurality of synchronizing levers; each of said synchronizing levers being pivotably connected at one end thereof to said pelvis-hip support plate by synchronizing lever pivot means, and each of said synchronizing levers being pivotably connected at the other end thereof to said seat support by transverse lever pivot means; and said synchronizing lever pivot means being disposed at a first distance from said first pivot means, and said transverse lever pivot means being disposed at a second distance from said second pivot means, said first and second distances being related such that when said front seat portion is pivoted, said pelvis-hip support is proportionately pivoted through a greater angle than said front seat portion.

3. Chair as defined in claim 2, wherein, in said working position, said third pivot axis of said backrest is disposed approximately 14 cm above said second pivot axis of said pelvis-hip support, said exit section being about half as long as said entrance section, and wherein said entrance section and said exit section are connected together by a curved section.

4. Chair as defined in claim 3, wherein said transverse lever pivot means is disposed downwardly and to the rear of said second pivot means such that a pivot ratio of relative pivoting between said rocker and said pelvis-hip support is approximately 1:2.5.

5. Chair as defined in claim 2, wherein said transverse lever pivot means is disposed downwardly and to the rear of said second pivot means such that a pivot ratio of relative pivoting between said rocker and said pelvis-hip support is approximately 1:2.5.

6. Chair as defined in claim 2, wherein said adjustment means includes a multiple disc clutch which is penetrated by a clamping rod that is manually controllable.

7. Chair as defined in claim 6, wherein said friction locking multiple disc clutch is rigidly connected with said pelvis-hip support by said transverse lever pivot means and by a transverse pin disposed parallel to said transverse lever pivot means, said friction locking multiple disc clutch extending below said front seat portion and having a frontal, broadened end which has an arcuate longitudinal slot through which passes said clamping rod.

8. Chair as defined in claim 6, further comprising a further friction locking multiple disc clutch which is pivotally connected to said seat support, by an elongated hole through which said clamping rod passes, about a stationary bearing axis of said seat support and extends in an approximately vertical direction, with the friction locking multiple discs of said friction locking multiple disc clutch for said pelvis-hip support and the friction locking multiple discs of said further friction locking multiple disc clutch for said rocker lying alternatingly against one another in the region of said clamping rod.

9. Chair as defined in claim 2, further comprising a vertical coil spring disposed between said supporting spindle and the front edge of said front seat portion to provide suspension for said rocker, and a means for changing the initial tension of said vertical coil spring, and further coil springs disposed on both sides of the vertical plane of symmetry of said seat surface, said further coil springs having a common plane of symmetry with said clamping rod.

10. Chair as defined in claim 2, further comprising a biasing means for biasing said pelvis-hip support from a lower pivot position to a higher pivot position.

11. An adjustable chair, comprising:

seat support means;

rocker means pivotably connected at one end thereof to said seat support means for pivoting about a first pivot axis;

a front seat portion supported by said rocker means;

pelvis-hip support means having one end pivotably connected to said rocker means for pivoting about a second pivot axis, said pelvis-hip support means including an entrance section which together with said front seat portion forms a seat surface;

synchronizing lever means pivotably connected at one end to said seat support means for pivoting about a synchronizing lever pivot axis which is spaced at a first distance from said first pivot axis, the other end of said synchronizing lever means being pivotably connected to said pelvis-hip support means for pivoting about a transverse lever pivot axis which is spaced at a second distance from said second pivot axis;

a backrest connected to the other end of said pelvis-hip support means;

said seat surface being movable between a first position and a second position, said first distance and said second distance being in such proportion that, during movement of said seat surface between said first position and said second position, said pelvis-hip support means pivots through a greater angle than does said seat support means.

12. An adjustable chair is claimed in claim 11, wherein said first position is a working position and said second position is a reclining position, said pelvis-hip support means having an exit section which is disposed approximately at a right angle to said entrance section, and wherein in said reclining position an uppermost surface of said entrance section of said pelvis-hip support means is generally level with an uppermost surface of said front seat portion.

13. An adjustable chair as claimed in claim 11, wherein said rocker means has another end, and further comprising an adjustable spring-biasing means for resiliently biasing said other end of said rocker means away from said seat support means.

14. An adjustable clair as claimed in claim 11, further comprising a clutch means for selectively locking said pelvis-hip support means in a selected position relative to said rocker means, said clutch means being pivotably connected to said seat support means.

15. An adjustable chair as claimed in claim 14, wherein said rocker means includes a pin, and said clutch means includes a coupling means, said coupling means having a slot which slideably receives said pin to constrain movement of said rocker means relative to said seat means to that permitted by the travel of said pin within said slot.

16. An adjustable chair as claimed in claim 15, wherein said clutch means includes a friction locking lever having one end pivotably connected to said pelvis-hip support means and having another end thereof connected to said coupling means, and a selective locking means for locking said another end of said friction locking lever in a selected position relative to said seat support means.

17. An adjustable chair as claimed in claim 11, wherein said pelvis-hip support means has another end, and wherein said backrest is pivotably connected to said other end of said pelvis-hip support means, and further comprising a resilient biasing means connected between said other end of said pelvis-hip support means and said backrest means to resiliently bias said backrest toward a predetermined position.

* * * * *